United States Patent [19]

Otani et al.

[11] Patent Number: 4,504,455

[45] Date of Patent: Mar. 12, 1985

[54] CARBONACEOUS PITCH, PROCESS FOR THE PREPARATION THEREOF AND USE THEREOF TO MAKE CARBON FIBERS

[75] Inventors: Sugio Otani, Kiryu; Shimpei Gomi, Tokyo; Fumio Mogi, Kiryu, all of Japan

[73] Assignee: Fuji Standard Research Inc., Tokyo, Japan

[21] Appl. No.: 577,695

[22] Filed: Feb. 7, 1984

[30] Foreign Application Priority Data

Feb. 8, 1983 [JP] Japan ..... 58-19168

[51] Int. Cl.[3] ..... C10C 3/06; C10C 3/08

[52] U.S. Cl. ..... 423/447.6; 423/447.4; 208/22; 208/39; 208/44

[58] Field of Search ..... 208/22, 39, 44; 423/447.2, 447.4, 447.6

[56] References Cited

U.S. PATENT DOCUMENTS

| | | | |
|---|---|---|---|
| 4,328,090 | 5/1982 | Stuckey, Jr. et al. | 208/44 |
| 4,414,096 | 11/1983 | Dickakian | 208/44 |
| 4,431,623 | 2/1984 | Fug | 208/44 |

*Primary Examiner*—Delbert E. Gantz
*Assistant Examiner*—Helane M. Myers
*Attorney, Agent, or Firm*—Pahl, Lorusso & Loud

[57] ABSTRACT

A novel reformed mesophase pitch having a mesophase content MC of between 40 and 100%, a quinoline-insoluble content QI of between 5 and 70 weight % and anisotropic domains forming a continuous phase. The reformed mesophase pitch is obtained by heat-treating a dormant mesophase pitch which comprises dormant anisotropic components which are partially hydrogenated, polycyclic polycondensed ring aromatic hydrocarbons derived from the mesophase of a mesophase pitch by hydrogenation of the mesophase and which are soluble in quinoline. The dormant mesophase pitch is optically isotropic in nature but, upon being subjected to shear forces in one direction, capable of being oriented in said direction. Preferably, the reformed mesophase pitch has a softening point SP in °C. satisfying the following conditions:

when $40 \leqq MC < 100$, $$0.4MC + 170 \leqq SP \leqq 1.25MC + 170 \text{ and}$$
$$SP \leqq 1.33QI + 220$$

and when $MC = 100$, $$210 \leqq SP \leqq 313 \text{ and}$$
$$SP \leqq 1.33QI + 220.$$

The reformed mesophase pitch is useful as precursor materials for carbon fibers.

22 Claims, No Drawings

CARBONACEOUS PITCH, PROCESS FOR THE PREPARATION THEREOF AND USE THEREOF TO MAKE CARBON FIBERS

BACKGROUND OF THE INVENTION

This invention relates generally to a novel carbonaceous pitch. More specifically, the present invention is concerned with a reformed mesophase pitch useful as precursor materials for carbon fibers having a high strength and a high modulus.

As precursor materials for carbon fibers, polyacrylonitrile fibers have been hitherto used. Due to the expensiveness and poor carbon yield of the polyacrylonitrile fibers, however, the use of carbonaceous pitches which are inexpensive and provide a high carbon yield have been proposed as a substitute for the acrylonitrile fibers in recent years.

As precursor materials for carbon fibers, both optically isotropic and anisotropic pitches have been employed. Natural and synthetic pitches are generally isotropic in nature and afford isotropic carbon fibers with low-strength and low-modulus. On the other hand, anisotropic pitches can form carbon fibers having a strength and a modulus as high as those obtained from rayon or acrylic fibers. Therefore, the recent trend in the production of carbon fibers is towards the use on anisotropic pitches as starting materials.

Anisotropic pitches may be produced by thermal treatment of natural or synthetic pitches which are generally composed of condensed ring aromatics of average molecular weight of a few hundred or less, and which are isotropic in nature. When such isotropic pitches are heated to a temperature of about 350°–450° C., anisotropic, small spheres begin to appear in the matrix of the isotropic pitch as a result of cyclization, aromatization, polycondensation and like reactions of the aromatics. These small spheres, which are considered to be liquid crystals of a nematic structure, are composed of relatively high molecular weight hydrocarbons having a polycyclic, condensed ring structure and a high aromaticity and which are insoluble in quinoline. With an increase in heat treatment time or temperature, these small spheres gradually grow in size and coalesce with each other. As coalescence continues, the pitches become anisotropic as a whole, with a simultaneous increase in viscosity, and are finally converted into coke. The optically anisotropic, small spheres or their coalesced domains are termed "the mesophase" and pitches containing such material are termed "mesophase pitches". Conventional carbon fibers or anisotropic structures can be produced by spinning a mesophase pitch, rendering the spun fibers infusible and carbonizing the infusible fibers, as disclosed in Japanese Published Examined Patent Publication No. 49-8634, Japanese Published Unexamined Patent Application Nos. 49-19127, 53-65425, 53-119326 and 54-160427.

However, the production of carbon fibers from mesophase pitches has been found to involve certain difficulties. The fundamental problem arises in the spinning step and is mainly ascribed to the fact that the mesophase components of the pitch have higher melting points and, in the molten state, a higher viscosity than the components forming the isotropic matrix of the pitch. More specifically, when for spinning the mesophase pitch is heated to a temperature so as to melt the isotropic matrix but not to melt the mesophase components, the pitch becomes thixotropic because of the presence of the solid-like phase mesophase components and, therefore, smooth spinning is seriously inhibited. If, on the other hand, the spinning temperature is raised to a temperature permitting the melting of the mesophase components, then the mesophase components, which are thermally unstable, gradually increase in viscosity because of polymerization and tend to form coke. Especially in the case of mesophase pitch having a high mesophase content, such coking proceeds very fast, to the extent that a continuous spinning operation is considerably inhibited. Thus, although anisotropic carbon fibers derived from mesophase pitches have superior mechanical properties in comparison with isotropic carbon fibers obtained from isotropic pitches, the production of the anisotropic fibers inherently involves a problem in the spinning step.

To solve this problem, there has been proposed the use of a mesophase pitch having a relatively small molecular weight and a low quinoline insoluble content for the production of carbon fibers. The strength of the carbon fibers derived from such a mesophase pitch, however, is not satisfactory though the modulus thereof is improved as compared with those obtained from synthetic polymeric materials such as polyacrylonitrile fibers.

SUMMARY OF THE INVENTION

The present invention provides a reformed mesophase pitch having optically anisotropic domains of a substantially continuous phase and being obtained by heat-treating a dormant mesophase pitch which comprises dormant anisotropic components which are partially hydrogenated, polycyclic polycondensed ring aromatic hydrocarbons derived from the mesophase of a mesophase pitch by hydrogenation of said mesophase and which are soluble in quinoline, said dormant mesophase pitch being optically isotropic in nature but, upon being subjected to shear forces in one direction, capable of being oriented in said direction, said reformed mesophase pitch having a mesophase content MC of between 40 and 100% and a quinoline-insoluble content QI of between 5 and 70 weight %.

Preferably, the reformed mesophase pitch has a softening point SP in °C. satisfying the following conditions:

when $40 \leqq MC < 100$, $$0.4MC + 170 \leqq SP \leqq 1.25MC + 170 \text{ and}$$
$$SP \leqq 1.33QI + 220$$

and when $MC = 100$, $$210 \leqq SP \leqq 313 \text{ and}$$
$$SP \leqq 1.33QI + 220.$$

In another aspect of the present invention, there is provided a process for preparing a reformed mesophase pitch, which comprises heat-treating a dormant mesophase pitch to form anisotropic domains of a substantially continuous phase, said dormant mesophase pitch comprising dormant anisotropic components which are partially hydrogenated, polycyclic polycondensed ring aromatic hydrocarbons derived from the mesophase of a mesophase pitch by hydrogenation of said mesophase and which are soluble in quinoline, said dormant mesophase pitch being optically isotropic in nature but, upon being subjected to shear forces in one direction, capable of being oriented in said direction.

In a still further aspect, the present invention provides a process for the production of a carbon fiber using the above reformed mesophase pitch. The present invention further provides a carbon fiber obtained by the above process.

It is, therefore, an object of the present invention to provide a novel carbonaceous pitch useful as a precursor material for carbon fibers with both a high strength and a high modulus.

Another object of the present invention is to provide a process by which a carbonaceous pitch having a high mesophase content and a low softening point can be prepared with a high yield.

It is a further object of the present invention to provide carbon fibers having both a high strength and a high modulus.

Other objects, features and advantages of the present invention will become apparent from the detailed description of the invention which follows.

DETAILED DESCRIPTION OF THE INVENTION

The novel carbonaceous pitch according to the present invention is called "reformed mesophase pitch" whose mesophase domains form a substantially continuous phase and which has a mesophase content MC of between 40 and 100% and a quinoline-insoluble content of between 5 and 70 weight %.

The reformed mesophase pitch is obtained by heat-treating a dormant mesophase pitch which comprises dormant anisotropic components which are partially hydrogenated, polycyclic polycondensed ring aromatic hydrocarbons derived from the mesophase of a mesophase pitch by hydrogenation of said mesophase and which are soluble in quinoline, said dormant mesophase pitch being optically isotropic in nature but, upon being subjected to shear forces in one direction, capable of being oriented in said direction.

The term "mesophase content" in the present specification is measured in the following manner. A mesophase pitch from the heat-treating step is rapidly cooled to room temperature within about 10 min for solidification. A part of the solidified pitch is embedded in a resin (Resin #101 manufactured by Marumoto Industries Co., Ltd., Japan) for fixation of the pitch in the conventional manner. The sample is then polished by means of an automatic optical polisher (manufactured by Marutoh Inc., Japan) until the surface of the pitch becomes mirror suitable for a photomicrographic analysis. A polarized light photomicrograph at a magnification of 100× of the polished sample is taken for the determination of its mesophase content in terms of the area of the optically anisotropic domains.

The term "quinoline-insoluble content" in the present invention is determined by quinoline extraction at 70° C. in accordance with Japanese Industrial Standard K2425.

The reformed mesophase pitch preferably has such a softening point SP in centigrade temperature (°C.) that when MC is at least 40% but is lower than 100%, SP is not lower than a value of the formula, $0.4MC+170$ but is not greater than a value of the formula, $1.25MC+170$ and a value of the formula, $1.33QI+220$, and when MC is 100%, SP is between 210 and 313 and is not greater than a value of the formula, $1.33QI+220$.

The "softening point" in the present invention is measured by means of a koka type flow tester (manufactured by Shimadzu Seisakusho Co., Ltd., Japan) and is the temperature at which a one gram sample starts to flow through a nozzle of 1 mm diameter under a pressure of 10 $Kg/cm^2$ and at a heating rate of 6° C./min.

The novel, reformed mesophase pitch is characterized by its low softening point and an excellent stability to heat notwithstanding its high mesophase content, a high molecular weight and a high H/C ratio (hydrogen to carbon atomic ratio). Therefore, the reformed mesophase pitch is very suited as precursor materials for carbon fibers because the temperature at which the pitch exhibits an optimum spinnability and gives a carbon fiber having a high strength and a high modulus is lower than that of the conventional mesophase pitch having a similar mesophase content and because both the strength and the modulus of the resultant carbon fiber are higher than those derived from the conventional mesophase pitch.

The reformed mesophase pitch may be prepared by a process including the steps of hydrogenating a mesophase pitch to obtain an optically isotropic, hydrogenated pitch, and thermally treating the hydrogenated pitch so that the resultant pitch becomes optically anisotropic and forms a substantially continuous phase of mesophase.

The mesophase pitch to be hydrogenated in the above process may be obtained by thermal treatment of an optically isotropic, natural or synthetic pitch, such as a petroleum pitch or a coal tar pitch, mainly composed of condensed ring aromatics having a boiling point of 450° C. or more. The resultant mesophase pitch can be hydrogenated as such or after the removal of light components contained therein. The mesophase pitch used for the process of the present invention has a H/C ratio of between 0.43 and 0.75, more preferably between 0.45 and 0.65, a mesophase content of between 1 and 90%, more preferably between 2 and 70% and a quinoline-insoluble content of between 0.5 and 60 weight %, more preferably between 1 and 35 weight %.

The hydrogenation is performed for the purpose of partially hydrogenating polycyclic, polycondensed ring aromatic hydrocarbons constituting the mesophase while maintaining the ring structure as much as possible and is continued until the pitch becomes substantially free from mesophase. Any known hydrogenation techniques customarily employed for hydrogenation of aromatic nuclei may be adopted. Illustrative of such hydrogenation techniques are: reduction using an alkali metal, an alkaline earth metal or a compound thereof; electrolytic reduction; homogeneous catalytic hydrogenation using a complex catalyst; and hetrogeneous catalytic hydrogenation using a solid catalyst containing one or more metals, for example, metals belonging to Group VIII of the Periodic Table. Other methods such as hydrogenation under pressure of hydrogen without using catalyst and hydrogenation using hydrogen donor such as tetralin, may also be used. It is preferred that the hydrogenation be effected while preventing hydrocracking as much as possible.

Reaction conditions under which the hydrogenation of the mesophase pitch is performed vary according to the hydrogenation method employed. Generally, the hydrogenation is conducted at a temperature not higher than about 400° C., preferably 250°-350° C. and a pressure of 1-200 atm. and, if necessary, using a suitable solvent or dispersing medium. In some cases, mesophase pitches may be subjected to hydrogenation conditions in the powdery or molten state.

The hydrogenation of the mesophase pitch is preferably carried out by reaction with hydrogen in the presence of a non-acidic catalyst including one or more hydrogenation catalytic metal components composited with a porous, refractory inorganic oxide carrier and having an average pore diameter of between about 150 and about 600 angstrom, at a temperature of between 250° and 380° C., preferably between 300° and 350° C. and a hydrogen pressure of between 30 and 250 $Kg/cm^2G$, preferably between 70 and 150 $Kg/cm^2G$. Preferably, the catalyst has a specific surface area of at least 70 $m^2/g$, an average pore diameter of between about 200 and about 400 angstrom and a total pore volume of at least 0.3 cc/g. Illustrative of suitable carriers are silica, magnesium silicate, calcium silicate, magnesia, calcium oxide, barium oxide, oxides of rare earth elements, alkali metal silicates and mixtures thereof.

The hydrogenated, substantially mesophase-free isotropic pitch thus obtained has an increase H/C ratio as compared with the non-hydrogenated mesophase pitch. The H/C ratio is generally in the range of between 0.55 and 1.5.

The hydrogenated pitch is then thermally treated at a temperature and a pressure and for a period of time so that a mesophase of a continuous phase may form. The heat treatment is preferably performed at a temperature of between 350° and 520° C., more preferably between 380° and 500° C. for a period of time of between 10 hours and 1 min, more preferably between 5 hours and 5 min under pressurized, normal or reduced pressure conditions in the atmosphere of an inert gas such as nitrogen and, if desired, with stirring. If necessary, the heat treatment may be followed by a distillation for the purpose of removing light components.

Through the above-described heat treatment, there is obtained a reformed mesophase pitch of the present invention having a good thermal and chemical stability. When the hydrogenated, mesophase-free, isotropic pitch is subjected to the heat treatment, optically anisotropic, small spheres begin to appear in the continuous phase or matrix of the isotropic pitch as a result of partial dehydrogenation, cyclization, aromatization, polycondensation and like reactions of the hydrocarbons contained in the mesophase-free pitch. As the heat treatment is further continued, these small spheres (mesophase) gradually grow in size and coalesce with each other. As the coalescence continues, the coalesced domains of mesophase form a continuous phase into which the isotropic pitch in the form of small spheres is dispersed. The isotropic small spheres disappear when the heat treatment is continued further. The mesophase small spheres produced at the initial stage of the above heat treatment have an improved compatibility with the isotropic matrix surrounding them as compared with that between the mesophase spheres and the isotropic matrix produced during the heat treatment of a non-hydrogenated isotropic pitch. Thus, the mesophase small spheres are easily deformable and, hence, the formation of the mesophase of a continuous phase is easily attained in the process of the present invention.

It is important that the heat treatment of the hydrogenated pitch should be continued until the mesophase forms a continuous phase. A mesophase-containing pitch in which the mesophase has not yet formed a continuous phase fails to exhibit satisfactory melt-spinnability.

The hydrogenated pitch becomes latently optically anisotropic pitch in the early stage of the heat treatment. The hydrogenated pitch as such may also exhibit, in some cases, a latent optical anisotropy. Such pitches exhibiting a latent anisotropy are called "dormant mesophase pitch" and are disclosed in Japanese Published Unexamined Patent Application No. 57-100186 (Applicant: Fuji Standard Research Inc.). The dormant mesophase pitch is comprised of latently optically anisotropic hydrocarbon components which are partially hydrogenated, polycyclic, polycondensed ring aromatic hydrocarbons derived from polycyclic, polycondensed ring aromatic hydrocarbons contained in a quinoline insoluble-containing pitch, such as the mesophase of a mesophase pitch, and which are substantially soluble in quinoline.

The dormant mesophase pitch, in contrast with conventional mesophase pitch, is optically isotropic in nature and is a homogeneous liquid in a single phase when heated above its melting point. When subject to shear forces in one direction, however, the dormant mesophase pitch, unlike the usual isotropic pitch, is converted into the optically anisotropic state due to the presence of the dormant anisotropic components capable of being oriented in the direction parallel to the direction of the applied forces.

The dormant mesophase pitch generally has a melting point in the range of about 150°-300° C. When heated above the melting point, it is non-thixotropic and exhibits Newtonian flow behavior. More specifically, it may exhibit a viscosity of below about 100 poises at a temperature of about 200°-300° C. Moreover, a dormant mesophase pitch which is substantially free of mesophase is stable and, in practice, does not undergo coking even if its is kept at a temperature of below about 350° C. The reformed mesophase pitch of the present invention is obtained from the dormant mesophase pitch.

The reformed mesophase pitch of the present invention has a mesophase content of at least 40%, preferably at least 60%, more preferably at least 90%, a quinoline-insoluble content of between 5 and 70 weight %, preferably between 10 and 60 weight %, and a H/C ratio of between 0.43 and 0.75. In spite of its relatively high content of mesophase of a high molecular weight and its high content of quinoline insolubles, the reformed mesophase pitch of this invention has a low softening point and a good thermal stability and, hence, an excellent melt-spinnability. In addition, the carbon fibers obtained from the reformed mesophase pitch according to the present invention exhibits superior mechanical properties, especially better tensile strength in comparison with those obtained from the conventional mesophase pitch.

The transformation of the reformed mesophase pitch into carbon fibers may be effected by a method including the steps of: heating the reformed mesophase pitch above its melting point, generally to a temperature of 200°-400° C.; spinning a carbonaceous fiber from the molten pitch; exposing the spun fiber to an oxygen-containing atmosphere so that the spun fiber is rendered infusible; and heat-treating the infusible fiber over about 800° C. in an inert atmosphere. The heat treatment suitably includes heating the infusible fiber at a temperature of 100°-1300° C., preferably gradually increasing the temperature at a rate of 5°-100° C./min, preferably 20°-50° C./min in an inert atmosphere, thereby carbonizing the fiber. The carbonized fiber is, if desired, further heated to a temperature of 2000°-2500° C. in an inert atmosphere for graphatization. Through such a heat treatment, molecular orientation in the direction parallel to the fiber axis is developed. The carbonized fiber generally has a tensile strength of at least 200 Kg/mm$^2$ and a Young's modulus of at least 18 ton/mm$^2$. The graphatized fiber generally has a tensile strength of at least 250 Kg/mm$^2$ and a Young's modulus of at least 30 ton/mm$^2$.

The following examples will further illustrate the present invention. In the examples, the letters "BI" and "CV" mean "benzene insolubles" and "coking value", respectively. The percentages of BI are determined by benzene extraction at 80° C.

EXAMPLE 1

An isotropic pitch, obtained from a product oil produced in a fluidized bed catalytic cracking and having a softening point of 88° C., a H/C ratio of 0.72, BI of 6.9 weight % and CV of 35.6 %, was heated under quiescent conditions at a temperature of 420° C. in an inert atmosphere for 3 hours to obtain a mesophase pitch having a H/C ratio of 0.63, BI of 29.9 weight %, QI of 3.2 weight % and CV of 53.5%. The measurement by a polarized light microscope revealed that the pitch had a mesophase content of 7%. The mesophase pitch, after being mixed with the same amount of methyl naphthalene used a solvent, was fed at a feed rate of 20 cc/hour to a fixed catalyst bed reactor charged with pressurized hydrogen and was upwardly streamed through the catalyst bed for hydrogenation. The catalyst was composed of a zeolite carrier having supported thereon Co and Mo. The hydrogenation was performed at a temperature of 350° C., a pressure of 140 Kg/cm$^2$G and a liquid hourly space velocity of 1 Hr$^{-1}$ with a hydrogen to oil feed ratio of 500 Nl/l. The hydrogenation product was discharged from the reactor and fed to a gas-liquid separator to remove a hydrogen-rich gas. The remaining oil was subjected to a reduced pressure condition at 25 mmHg to remove the solvent and light hydrocarbon components, thereby leaving a hydrogenated isotropic pitch having a H/C ratio of 0.78, BI of 10.2 weight % and CV of 26.6%.

The hydrogenated isotropic pitch was then heat-treated in an inert atmosphere at a temperature of 480° C. and a pressure of 660 mmHg for 25 min to obtain a reformed mesophase pitch having a softening point of 250° C., a H/C ratio of 0.56 and QI of 53.9 weight %. The polarized light microscopic analysis revealed that the reformed mesophase pitch had a mesophase content MC of 85% and that the mesophase formed a continuous phase.

The reformed mesophase pitch was spun into fibers by means of an extruder having a orifice diameter of 0.3 mm and a L/D ratio of 3. The spinning operation was conducted at a temperature of 305° C., a spinning pressure of 2.5 Kg/cm$^2$G and a spinning rate of 200 m/min. The spinnability was found to be very good.

The spun fibers were gradually heated in the air at a heat-up rate of 1° C./min from 150° C. to 300° C. and then maintained at 300° C. for 30 min so that the fibers were rendered infusible. The infusible fibers were subsequently heated up to 1000° C. in an atmosphere of nitrogen at a heat-up rate of 5° C./min and maintained at that temperature for 10 min to obtain carbonized fibers having a tensile strength of 350 Kg/mm$^2$ and a Young's modulus of 22000 Kg/mm$^2$. A further heat treatment of the thus obtained carbonized fibers up to 2500° C. at a heat-up rate of 20° C./min gave graphatized fibers having a tensile strength of 320 Kg/mm$^2$ and a Young's modulus of 40000 Kg/cm$^2$.

EXAMPLE 2

The same isotropic pitch as used in Example 1 was heated under quiescent conditions at a temperature of 400° C. in an inert atmosphere for 2 hours to obtain a mesophase pitch having a H/C ratio of 0.69, a softening point of 163° C., BI of 19.2 weight %, QI of 1.5 weight %, CV of 43.9% and MC of 3%. The mesophase pitch, after being ground to powder, was hydrogenated at a temperature of 90°-110° C. for 2 hours in the presence of metallic lithium and ethylenediamine according to a Benkeser method to obtain a hydrogenated isotropic pitch having a H/C ratio of 1.17, BI of 8.5 weight % and CV of 24.0%. The hydrogenated isotropic pitch was then heat-treated at a temperature of 440° C. and a pressure of 60 mmHg in an inert atmosphere for 90 min to obtain a reformed mesophase pitch having a softening point of 230° C., a H/C ratio of 0.62, QI of 25.5 weight % and a mesophase content MC of 58%. The reformed mesophase pitch was spun into fibers using the same spinning device as used in Example 1 at a spinning temperature of 300° C., spinning pressure of 1.5 Kg/cm$^2$G and a spinning rate of 300 m/min. The spun fibers were rendered infusible, carbonized and then graphatized in the same manner as described in Example 1. The carbonized fibers had a tensile strength of 320 Kg/mm$^2$ and a Young's modulus of 21000 Kg/mm$^2$ while the graphatized fibers had a tensile strength of 290 Kg/mm$^2$ and a Young's modulus of 40000 Kg/mm$^2$.

Comparative Example 1

The isotropic pitch used in Example 1 was heated under quiescent conditions at a temperature of 500° C. and a pressure of 60 mmHg for 10 min to obtain a mesophase pitch having a softening point of 314° C., a H/C ratio of 0.52, QI of 74.8 weight % and a mesophase content of about 100L %. It was impossible to effect melt-spinning of the mesophase pitch at a temperature of 400° C. and a pressure of 3.0 Kg/cm$^2$.

Comparative Example 2

The isotropic pitch used in Example 1 was heated under quiescent conditions at a temperature of 460° C. and a pressure of 60 mmHg for 50 min to obtain a mesophase pitch having a softening point of 248° C., a H/C ratio of 0.58, QI of 30.7 weight % and mesophase content of 60%. Using the spinning device described in Example 1, the mesophase pitch was then spun into fibers at a temperature of 325° C. and a pressure of 2.5 Kg/cm$^2$G. The spinnability was found to be bad and the spinning was carried out at a spinning rate of 60 m/min. The spun fibers were then rendered infusible, carbonized and graphatized in the same manner as described in Example 1. The carbonized fibers had a tensile strength of 160 Kg/mm$^2$ and a Young's modulus of 16000 Kg/mm$^2$ while the graphatized fibers had a tensile strength of 140 Kg/mm$^2$ and a Young's modulus of 18000 Kg/mm$^2$.

EXAMPLE 3

Using the hydrogenated isotropic pitch obtained in Example 1 and having a H/C ratio of 0.78, BI of 10.2 weight % and CV of 26.6 was heat-treated at various temperatures within the range of between 400° and 500°

C. in an inert atmosphere to obtain reformed mesophase pitches of this invention having various different mesophase contents as shown in Table 1. The H/C ratio and the softening point of each of the reformed mesophase pitches are also shown in Table 1.

Each of the thus obtained reformed mesophase pitches was spun into fibers using the same spinning device as used in Example 1. The temperature at which each pitch exhibits an optimum spinnability and gives a carbon fiber of a high strength is shown in Table 2 together with the spinning rate at which the spun fibers show the highest strength.

For the purpose of comparison, the isotropic pitch used in Example 1 was heated under quiescent conditions at various temperatures within the range of 400°-500° C. to obtain conventional mesophase pitches having various mesophase contents as shown in Table 1. The H/C ratios and the softening points of the conventional mesophase pitches are also shown in Table 1. Further, the results of the spinnability test for the conventional mesophase pitches are shown in Table 2.

TABLE 1

| Conventional Mesophase Pitch | | | | Reformed Mesophase Pitch | | | |
|---|---|---|---|---|---|---|---|
| MC | SP | H/C | QI | MC | SP | H/C | QI |
| 60 | 248 | 0.58 | 30.7 | 60 | 220 | 0.59 | 13.5 |
| 70 | 262 | 0.58 | 32.0 | 70 | — | — | — |
| 80 | 276 | 0.56 | 35.6 | 80 | 240 | 0.57 | 37.0 |
| 90 | 287 | 0.54 | 47.0 | 90 | 253 | 0.55 | 55.0 |
| 100 | 299 | 0.53 | 52.0 | 100*1 | 260 | 0.55 | 57.9 |
| — | — | — | — | 100*2 | 297 | 0.54 | 65.0 |

*1, *2The reformed mesophase pitch *2 was obtained by heating the pitch *1 at 500° C. and 60 mm Hg for 5 min. Generally, SP, QI and MC increase with the increase in heat treatment time (and/or temperature). However, MC cannot increase any more after reaching 100%.

TABLE 2

| Conventional Mesophase Pitch | | | Reformed Mesophase Pitch | | |
|---|---|---|---|---|---|
| MC | Optimum Spinning Temperature (°C.) | Spinning Rate (m/min) | MC | Optimum Spinning Temperature (°C.) | Spinning Rate (m/min) |
| 60 | 325 | <60 | 60 | 300 | 400 |
| 70 | 335 | 100 | 70 | — | — |
| 80 | 345 | <60 | 80 | 305 | 400 |
| 90 | 360 | *4 | 90 | 310 | 350 |
| 100 | *3 | | 100*1 | 315 | 300 |
| — | — | — | 100*2 | 355 | 300 |

*1, *2See above
*3Impossible to spin at 380° C.
*4Difficult to spin

From the results shown in Table 1, it will be seen that any reformed mesophase pitch of the present invention has a lower softening point and a greater H/C ratio than the corresponding mesophase pitch having the same mesophase content. The results summarized in Table 2 show that the reformed mesophase pitch of this invention can be spun into fibers at a lower spinning temperature and a high spinning rate in comparison with the conventional mesophase pitch having the similar mesophase content. Especially, the reformed mesophase pitch having mesophase contents of 90 and 100% can be spun into fibers at spinning temperatures of 310° and 315° C. and spinning rates of 350 and 300 m/min, respectively. This is quite surprising because it has not been considered to be possible to spin fibers from mesophase pitches having a mesophase content of 90% or more.

We claim:

1. A reformed mesophase pitch obtained by heat-treating a dormant mesophase pitch which comprises dormant anisotropic components until a continuous phase of anisotropic domains is formed;

said dormant anisotropic components being partially hydrogenated, polycyclic polycondensed ring aromatic hydrocarbons derived from the mesophase of a mesophase pitch by hydrogenation of said mesophase and being soluble, in quinoline, and said dormant mesophase pitch being optically isotropic in nature but, upon being subjected to shear forces in one direction, capable of being oriented in said direction, and said reformed mesophase pitch having a mesophase content MC of between 40 and 100% and a quinoline-insoluble content QI of between 5 and 70 weight %.

2. A reformed mesophase pitch as claimed in claim 1, and having a softening point SP in °C. satisfying the following conditions:

when $40 \leqq MC < 100$, $$0.4MC + 170 \leqq SP \leqq 1.25MC + 170 \text{ and}$$
$$SP \leqq 1.33QI + 220$$

and when $MC = 100$, $$210 \leqq SP \leqq 313 \text{ and}$$
$$SP \leqq 1.33QI + 220.$$

3. A reformed mesophase pitch as claimed in claim 1, and having MC of between 60 and 100%.

4. A reformed mesophase pitch as claimed in claim 1, and having MC of between 90 and 100%.

5. A reformed mesophase pitch as claimed in claim 1, and having QI of between 10 and 60%.

6. A reformed mesophase pitch as claimed in claim 1, and having a H/C ratio of between 0.43 and 0.75.

7. A process for the preparation of a reformed mesophase pitch, comprising heat-treating a dormant mesophase pitch to form a continuous phase of anisotropic domains, said dormant mesophase pitch comprising dormant anisotropic components which are partially hydrogenated, polycyclic polycondensed ring aromatic hydrocarbons derived from the mesophase of a mesophase pitch by hydrogenation of said mesophase and which are soluble in quinoline, and said dormant mesophase pitch being optically isotropic in nature but, upon being subjected to shear forces in one direction, capable of being oriented in said direction.

8. A process as claimed in claim 7, wherein said heat treatment is conducted so that the product of the heat treatment has a mesophase content MC of between 40 and 100%, a quinoline content QI of between 5 and 70 weight % and a softening point SP satisfying the following conditions:

when $40 \leqq MC < 100$ $$0.4MC + 170 \leqq SP \leqq 1.25MC + 170$$
$$SP \leqq 1.33QI + 220$$

and when $MC = 100$ $$210 \leqq SP \leqq 313$$

$$SP \leqq 1.33QI + 220.$$

9. A process as claimed in claim 7, wherein said dormant mesophase is obtained by hydrogenating the mesophase of a mesophase pitch so that mesophase is rendered soluble in quinoline.

10. A process as claimed in claim 9, wherein said mesophase pitch is subjected to hydrogenating conditions so that substantially all the mesophase contained therein is rendered soluble in quinoline.

11. A process as claimed in claim 7, wherein said mesophase pitch has a H/C ratio of between 0.43 and 0.75.

12. A process as claimed in claim 7, wherein said mesophase pitch has a mesophase content of between 1 and 90 weight %.

13. A process as claimed in claim 9, wherein the product of said hydrogenation is heated above its melting point for a period of time sufficient to remove low boiling point components therefrom.

14. A process for the production of a carbon fiber comprising the steps of:

heating a reformed mesophase pitch of claim 1 above its melting point;

spinning a carbonaceous fiber from said molten pitch;

exposing said spun fiber in an oxygen-containing atmosphere so that said spun fiber is rendered infusible; and heat-treating said infusible fiber at temperatures above 800° C.

15. The reformed mesophase pitch of claim 1 formed by heat-treating said dormant mesophase pitch at 350°-520° C. for 1 minute to 10 hours.

16. The process of claim 7 wherein said heat-treating is at 350°-520° C. for 1 minute to 10 hours.

17. The reformed mesophase pitch of claim 1 formed by heat-treating a hydrogenated pitch substantially free of mesophase.

18. The process of claim 7 wherein said hydrogenating is continued until the pitch becomes substantially free from mesophase.

19. The process of claim 7 wherein the hydrogenated pitch exhibits a latent optical anisotropy.

20. The process of claim 7 wherein said dormant mesophase pitch is formed from said hydrogenated pitch at an early stage of said heat-treating.

21. The reformed mesophase pitch of claim 1 formed by heat-treating a hydrogenated pitch exhibiting latent optical anisotropy.

22. The reformed mesophase pitch of claim 1 formed by heat-treating an isotropic hydrogenated pitch.

* * * * *